US007867113B2

(12) United States Patent
Petersen

(10) Patent No.: US 7,867,113 B2
(45) Date of Patent: Jan. 11, 2011

(54) GOAL DETECTOR FOR DETECTION OF AN OBJECT PASSING A GOAL PLANE

(75) Inventor: Hans Petersen, Maarslet (DK)

(73) Assignee: Goalref APS (DK)

( * ) Notice: Subject to any disclaimer, the term of this patent is extended or adjusted under 35 U.S.C. 154(b) by 1141 days.

(21) Appl. No.: 10/547,115

(22) PCT Filed: Mar. 1, 2004

(86) PCT No.: PCT/DK2004/000137

§ 371 (c)(1),
(2), (4) Date: Apr. 27, 2006

(87) PCT Pub. No.: WO2004/076003

PCT Pub. Date: Sep. 10, 2004

(65) Prior Publication Data

US 2006/0247076 A1 Nov. 2, 2006

(30) Foreign Application Priority Data

Feb. 28, 2003 (DK) ..... 2003 00325

(51) Int. Cl.
*A63B 63/00* (2006.01)

(52) U.S. Cl. ..... 473/471; 273/271

(58) Field of Classification Search ..... 473/478, 473/471; 340/323 R; 463/40–42; 273/271, 273/392, 57.2, 314
See application file for complete search history.

(56) References Cited

U.S. PATENT DOCUMENTS 4,375,289 A 3/1983 Schmall et al.
4,675,816 A 6/1987 Brandon et al.

(Continued)

FOREIGN PATENT DOCUMENTS

DE 42 33 341 4/1994

(Continued)

OTHER PUBLICATIONS

International Search Report; PCT/DK2004/000137; Jun. 17, 2004.

*Primary Examiner*—Peter DungBa Vo
*Assistant Examiner*—Masud Ahmed
(74) *Attorney, Agent, or Firm*—Cantor Colburn LLP

(57) ABSTRACT

A system is disclosed for detection of whether a movable object, such as a sports object, e.g. a football or an ice hockey puck, has passed a flat plane in space, such as a goal plane defined e.g. as a vertical plane extending from a goal line or a horizontal plane defined by the upper rim of the basketball basket. The system comprises a plurality of pairs of antennas arranged along the periphery of the flat target plane, the two antennas of each of said pairs being arranged with a mutual displacement in the direction perpendicularly to the flat target plane, radio wave emitter means arranged in the movable object and/or each antenna, and means for receiving the radio waves from the radio wave emitter means and provide an output accordingly arranged in each antenna and/or in the movable object, the system further comprising processing means to receive and process said output together with a predetermined set of conditions and providing a resulting output if the set of conditions are fulfilled so as to determine whether the movable object passes the flat target plane.

17 Claims, 2 Drawing Sheets

U.S. PATENT DOCUMENTS

| | | | | | |
|---|---|---|---|---|---|
| 4,956,775 | A | * | 9/1990 | Klamer et al. | 473/480 |
| 5,346,210 | A | * | 9/1994 | Utke et al. | 473/415 |
| 5,498,000 | A | * | 3/1996 | Cuneo | 473/471 |
| 5,615,880 | A | * | 4/1997 | Booth et al. | 473/471 |
| 5,748,073 | A | * | 5/1998 | Crawford | 340/323 R |
| 5,976,038 | A | * | 11/1999 | Orenstein et al. | 473/467 |

FOREIGN PATENT DOCUMENTS

| | | |
|---|---|---|
| EP | 2 726 370 | 5/1996 |
| FR | 2726370 | 5/1996 |
| FR | 2 753 633 | 3/1998 |
| GB | 2 342 050 | 4/2000 |
| SU | 971 370 | 11/1982 |
| WO | WO 98/37932 | 9/1998 |
| WO | WO 99/34230 | 7/1999 |
| WO | WO 00/47291 | 8/2000 |
| WO | WO 01/66201 | 9/2001 |

* cited by examiner

GOAL DETECTOR FOR DETECTION OF AN OBJECT PASSING A GOAL PLANE

TECHNICAL FIELD OF THE INVENTION

The present invention relates to a system for detection of whether a movable object, such as a sports object, e.g. a football or an ice hockey puck, has passed a flat plane in space, such as a goal plane defined e.g. as a vertical plane extending from a goal line or a horizontal plane defined by the upper rim of the basketball basket.

BACKGROUND

Traditionally, the referee or referees of a sports match decides from visual observation whether or not the ball has passed the goal plane. However, this may be very difficult to determine correctly in situations where the ball is returned quickly and has only just passed, or not passed, the goal plane, and it is particularly difficult if the referee is positioned unsuitably with respect to the goal plane or is engaged in other activity of the match. Video camera may also be used to monitor the goal planes, but the spatial and temporal resolution of video cameras are often not sufficient to provide the necessary information in cases of doubt.

A number of electronic systems are known in the art for determining the position of a ball on a sports field by means of position systems, as disclosed in e.g. WO 01/66201, FR 2 753 633, FR 2 726 370, WO 99/34230, U.S. Pat. No. 4,675,816, U.S. Pat. No. 5,346,210 and WO 98/37932. These positioning systems may be used e.g. for determining if the ball has passed the border of the playing field and the positions of the players as well and provides many useful information to the referee. However, the determination of the passage of the goal plane is a very delicate matter, both because it may be decisive for the outcome of the sports match and because the distances are small and the velocity of the object often very high, so that a position determining system to provide a reliable determination of whether the object has passed the goal plane must be very precise in the determination of the position and at the same time have a very high update rate of the position determination. The object may e.g. move with 72 km/h or 20 m/s, which means that an update rate of 1/100 s will add an uncertainty of 20 cm to the determined position, which is unacceptable with respect to determination of a goal in a sports match.

WO 00/47291 and U.S. Pat. No. 4,375,289 discloses devices for detecting the position of a moving object relative to a plane, wherein an energizing coil generates an electromagnetic field, which is disturbed by the moving object. The disturbance is detected by one or two coils from which it is decided whether and when the object passed the plane encircled by the energizing coil as well as the detection coils. These devices requires the coils to encircle the full goal plane and are very sensitive to any deviation from the precise and correct positioning of the coils as no calibration for such deviations is available, and the detection may also be severely disturbed by other object in or near the goal plane, such as a goal keeper or other players. Furthermore, players within the vicinity of the goal plane will be exposed to the generated electromagnetic field, a fact that may raise health related concerns.

Position systems with a sufficiently precise determination of the position of a sports object and a sufficiently high update rate to provide reliable indications of the crossing of a goal plane, are very expensive to install and maintain. It is therefore desirable to provide an alternative system with a sufficient spatial as well as temporal resolution to provide reliable indications.

U.S. Pat. No. 5,976,038 discloses an apparatus for providing an output indication when a playing object crosses the play determinative line. The apparatus comprises a directional receiving antenna, such as a disk-reflector antenna and in particular a cassegrain antenna provided with dual, horizontally adjacent feeds, which are combined to provide sum and difference signals. The antenna is arranged outside the playing field and is directed along the play determinative line. In order to provide a sufficiently high spatial resolution due to the distance between the antenna and the playing object, the reflector of the antenna must have considerable dimensions. A reflector of 30 inch width, 76 cm, will provide a detection zone of 4 inch width, 10 cm, which together with other uncertainties of the system is acceptable for use with American football as the patent is directed at, but is unacceptable for many other sports games and a much larger reflector would be required.

It is therefore desirable to provide a technically more simple system for determining the crossing of a goal plane with a sufficient spatial as well as temporal resolution to provide reliable indications.

BRIEF SUMMARY OF THE INVENTION

The invention provides a system comprising a plurality, preferably at least three pairs of antennas arranged along the periphery of a flat target plane, the antennas of each of said pairs being arranged with a displacement there between in the direction perpendicularly to the flat target plane. The antennas are suitable to receive the radio waves from movable objects, e.g. a football or other sport playing objects, having radio wave emitter means, and/or are suitable to emit radio waves, that are received by receiver means in the movable object.

By arranging a plurality of pairs of antennas, such as two, three or more pairs of antennas, along the periphery of the target plane, preferably on or adjacent to the line delimiting the target plane, the distance between the antennas and the movable object may be reduced to an absolute minimum, whereby the spatial resolution of the pairs of antennas is maximized. Thus, simple antennas may be employed and a satisfactory spatial resolution achieved by the system according to the present invention. Data processing means collect the output from the various antennas of the system or from a receiver means in the movable object, process the collected data and compare to a predetermined sat of conditions, and provide an output accordingly. The output is typically provided when the centre of the object passes the target plane, which in a preferred embodiment of the invention equals the moment when the difference between the outputs from the two antennas divided by the sum of the two outputs is at a minimum.

Other preferred features of the present invention and advantages will be disclosed in the following.

Thus, the present invention relates to a system comprising

- a movable object, in particular a sports object, e.g. a football or an ice hockey puck, having radio wave emitter means,
- a plurality of pairs of antennas arranged along the periphery of a flat target plane, the two antennas of each of said pairs being arranged with a mutual displacement in the direction perpendicularly to the flat target plane,
- radio wave emitter means arranged in the movable object and/or each antenna, and means for receiving the radio waves from the radio wave emitter means and provide an output accordingly arranged in each antenna and/or in the movable object, the system further comprising processing means to receive and process said output together with a predetermined set of conditions and providing a resulting output if the set of conditions are fulfilled so as to determine whether the movable object passes the flat target plane.

The radio wave emitter means may be a transmitter arranged in the movable object with an internal power source, i.e. an electrical battery, or an externally driven source, such as an induction circuit generating power from an external source of a magnetic field. Alternatively, the radio wave emitter means may be reflector means for reflecting radio waves emitted from a stationary source, e.g. as described in U.S. Pat. No. 5,976,038.

The processing means process the output from all the antennas of the system, e.g. by calculating the sum and difference of the outputs of the antennas of each pair and calculate the ratio of the difference and the sum as described below. When this ratio is at its minimum, the radio wave emitter means passes the middle plane between the two antennas. The outputs from the two antennas of a pair may furthermore be calibrated for differences in magnitude of output, so that the ratio is zero at the minimum. The ratios obtained from all pairs of antennas are used to provide a common conclusive output and thereby compensate for uncertainties of the individual pair and maladjustments due to impacts during the sports game.

In a second embodiment, the radio wave emitter means is the plurality of pairs of antennas and the receiver is placed within the movable object. In a third embodiment, the first and second embodiment is combined to a system where the passage of the movable object is detected by both systems so that a higher reliability is obtained.

The mutual displacement in the direction normal to the target plane between the antennas of each pair is advantageously within the range of 3 to 25 centimeters, preferably within the range of 6 to 12 centimeters.

The number of pairs of antennas is advantageously within the range of 3 to 20, preferably within the range of 4 to 12.

It is preferred that at least some of the pairs of antennas are arranged in series along a horizontal line of the target plane, and it is particularly preferred that the pairs of antennas are arranged substantially equidistantly along said line. The line may be the goal line on the ground, so that the pairs of antennas have a subsurface location, or the pairs of antennas may be arranged on the horizontal crossbar of the goal. The pairs of antennas may preferably be arranged with a mutual distance being a fraction, such as one half, one third, one fourth, etc. of the wavelength of the radio waves, but preferably half the wavelength of the radio waves emitted from the emitter means. Thereby, an optimal transmission is obtained. The wavelength of the radio waves is preferably within the range of 0.2 meters to 20 meters, preferably within 0.5 to 5 meters.

It is generally preferred that at least some of and possibly all of the pairs of antennas are arranged on the goal delimiting the flat target plane, the goal normally consisting of two substantially vertical goalposts and a horizontal crossbar extending there between. The pairs of antennas may be arranged on the crossbar as described, on the goalposts or distributed on both the crossbar and the two goalposts. The pairs of antennas arranged on the goal are preferably embedded within the goalposts and/or the horizontal crossbar so that a substantially smooth surface of the goal is preserved.

It is furthermore advantageous that the system of the invention comprises at least one stationary calibrator device emitting waves receivable by the antennas, arranged in the flat target plane to provide a calibration signal for the system. Thereby, a temporary or constant calibration routine may be performed by the system during use so as to compensate for changes in the position, orientation or other features of the antennas that are influential on their performance and output. The one or more stationary emitters are advantageously arranged on the goal. Alternatively, according to the second or third embodiment of the present invention, the stationary calibrator device may receive radio waves emitted from the pairs of antennas and provide an output accordingly to a control unit of the system. Supplementary or as an alternative to the calibrator device, each pair of antennas may be equipped with means, such as a dedicated receiver, for determining their position by means of a common positioning system, such as the satellite based Global Positioning System (GPS) so that deviations from the ideal positioning of the pairs of antennas may be detected and the evaluation of the system may be adjusted therefore.

In order to facilitate the signal processing and improve the precision of the output, i.e. the spatial resolution of the resulting output from the system, it is advantageous that each pair of antennas has a first antenna arranged in a first plane parallel to said flat target plane and a second antenna arranged in a second plane parallel to said flat target plane, wherein said first plane and second plane are common to all or substantially all pairs of antennas.

The radio wave emitter means and/or the receiver means of the movable object comprises in a preferred embodiment of the present invention antenna means that are regularly distributed in a shell of a shape corresponding to the outer shape of said movable object, so as to provide a homogeneous wave field with its centre in the middle of the object. In particular, it is preferred that the antenna means is arranged on the inner surface of the top layer material of said movable object. Thereby, a simple manufacturing may be performed with a high degree of precision so as to delimit the spatial uncertainties of the system.

The present invention relates furthermore to a movable object, in particular to a ball, such as a football, or other sport playing object suitable to be comprised within said system.

The system of the invention may also comprise one or more video cameras that are activated by the output from the system, so that a precisely timed goal photo is obtained for visual evaluation of the situation.

BRIEF DESCRIPTION OF THE DRAWING

An embodiment of the present invention is shown in the enclosed drawing of which

DETAILED DESCRIPTION OF AN EMBODIMENT OF THE INVENTION

Figure 1:
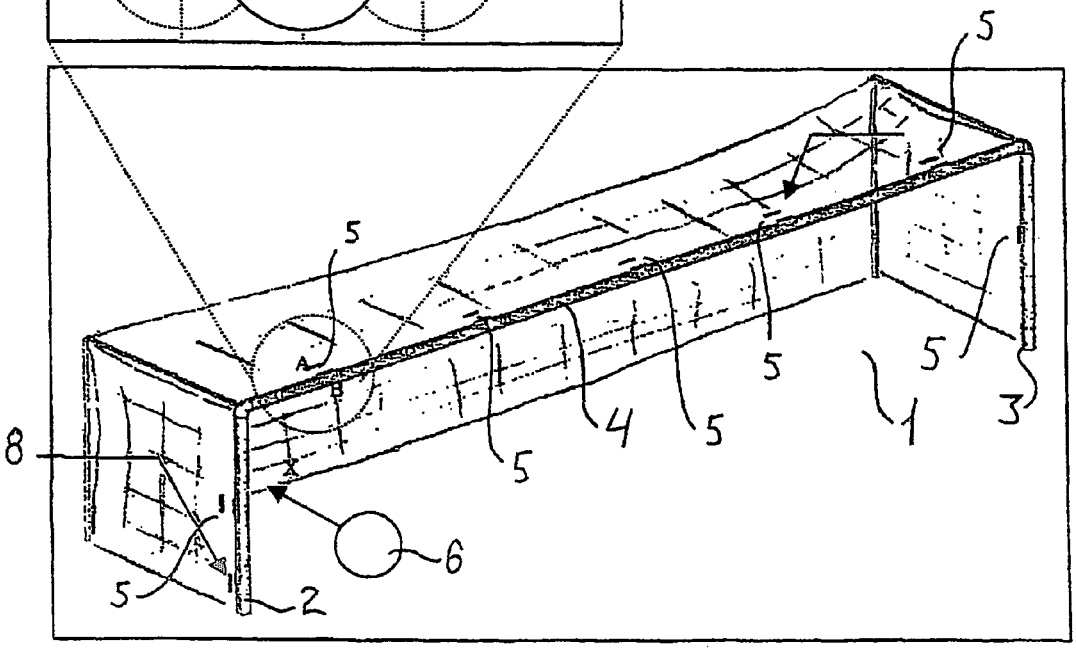
FIG. 1 is a perspective view of a goal for football equipped with a plurality of pairs of antennas and an auto-calibration transmitter.

A football goal 1 is shown in FIG. 1 having a left goalpost 2, a right goalpost 3 and a horizontal crossbar 4 there between.

The goal 1 is placed on a sports field with the posts 2, 3 placed on the centre of the goal line (not shown) and the crossbar 4 being parallel with and directly above the goal line in accordance with the laws of FIFA, so that the goal line, the posts 2, 3 and the cross bar 4 delimits a flat target plane.

Five pairs of antennas 5 are arranged equidistantly on the crossbar 4 and two pairs 5 are arranged each on one post 2, 3. Each pair of antennas 5 comprises two identical antennas A, B that are arranged parallel with a displacement only in the direction perpendicular to the target plane. The antennas A, B are arranged so that the midway position is situated precisely half the diameter of the ball from the back edge of the goal line. A goal is scored when the whole of the ball pass over the goal line, between the goalposts 2, 3 and under the cross bar 4, cf. the laws of FIFA. Thus, when the middle of the ball is in the vertical plane of the midway positions of the pairs of antennas 5, the goal is scored except if other laws of the game overrule it.

Figure 2:
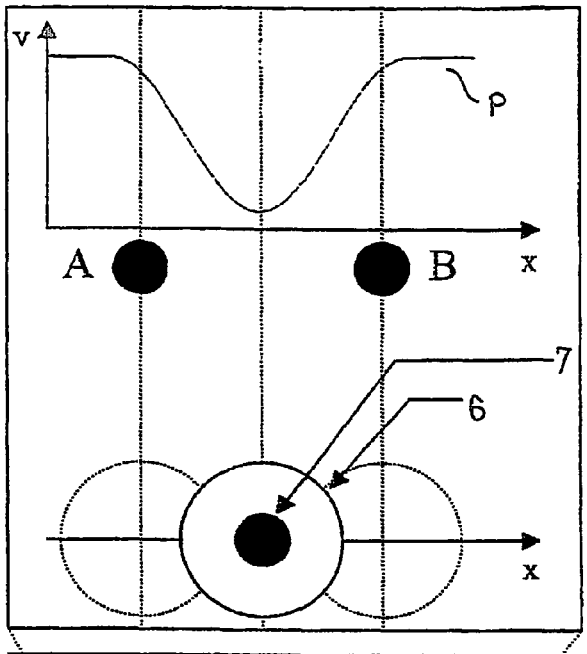
FIG. 2 is an illustration of the antennas of a pair, the ball, and an output signal of a pair of antennas during the passage of a ball.

A cross-section of the antennas A, B is illustrated in FIG. 2 with the ball 6 illustrated in three positions, the ball 6 having a transmitter 7 effectively arranged in the middle thereof. The processed signal is depicted as well as signal V as function of the position X of the ball perpendicularly to the target plane. The processing means (not shown) provides the output P from the signal SA, SB from the two antennas A, B:

$$P = \frac{|SA - SB|}{|SA| + |SB|}$$

The processing of the signals is performed with a very high frequency, more than 10 kHz, and the output from the antennas A, B are constantly calibrated by means of the waves transmitted from the auto-calibration transmitter 8, so that the output P=0 when the middle of the ball is in the vertical plane of the midway positions of the pairs of antennas 5. The resulting output from the system, indicating that a goal is scored, is produced by the processing means by a routine including the output signals P from all pairs of antennas 5.

Figure 3:
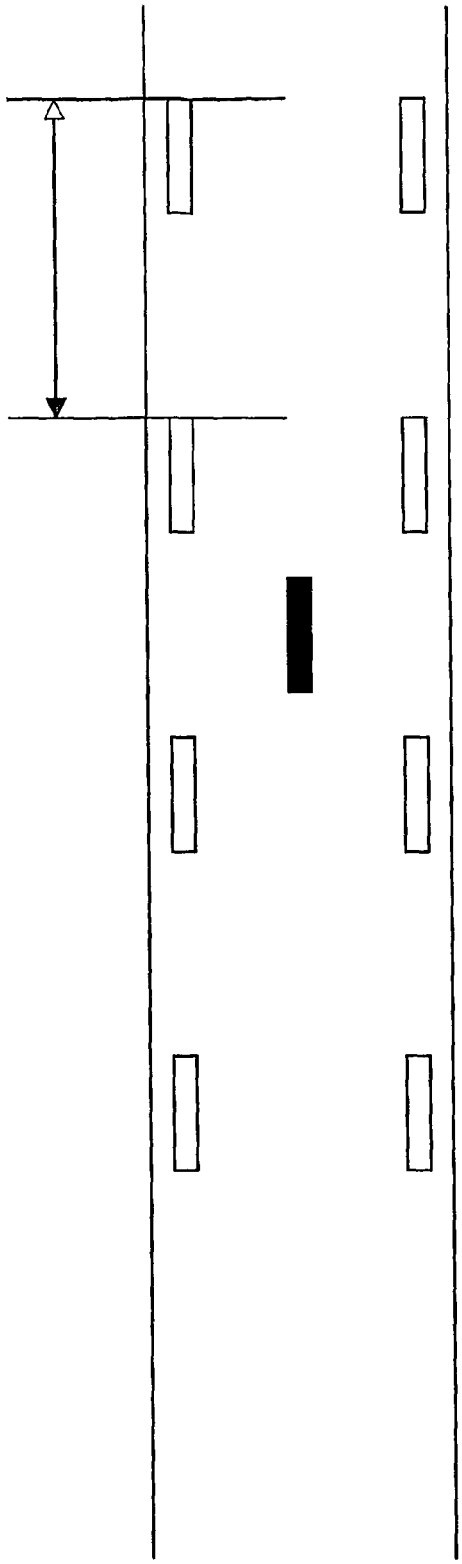
FIG. 3 is a detail of the cross bar of a goal having a plurality of pairs of antennas and an auto-calibration transmitter arranged therein.

An examples of the arrangement of pairs of antennas 5 and an auto-calibration transmitter 8 within the cross bar 4 of a goal 1 is illustrated in FIG. 3, where the antennas 5 and the transmitter 8 are completely embedded into the cross bar 4 to that a substantially smooth surface of the cross bar 4 is preserved. Thus, the players will not meet sharp edges or protrusions on the structure of the goal at physical contact with it, which may cause injuries to the players as well as to the antennas 5 and the transmitter 8. The adjacent pairs of antennas 5 are arranged with a mutual distance 9 of half the wavelength of the radio waves emitted from the emitter means.

The pairs of antennas 5 may in a further preferred embodiment alternatively or additionally function as emitter means emitting a radio wave that is received by receiving means in the ball 6 as well as receiving means in the auto-calibration transmitter 8, so that the performance of the antennas 5 may be evaluated and the final output from the system be adjusted for deviations in the system from the ideal function and positioning.

Thus, in one embodiment of the system, the emitter means are situated in the ball 6, an auto-calibration signal is provided from the auto-calibration transmitters 8 and the receiver means are in the pairs of antennas 5.

In a second embodiment, the emitter means are the pairs of antennas 5 and the receiver means are situated in the ball 6, which furthermore comprises a second emitter means for emitting a signal evaluated from the received signal, where a second receiver means is arranged at the sports field to receive said signal and process it to determine whether the ball 6 passes the target plane, i.e. the goal plane. In the second embodiment, the antennas 5A in the front of each pair of antennas 5 may optionally emit radio waves of one frequency and the antenna 5B in the back may emit radio waves of a different frequency in order to separate the received waves e.g. by the receiver means in the ball 6, or the signals from the two antennas 5A, 5B may be distinguishable in any other technical manner. Furthermore, the auto-calibration transmitters 8 are in this embodiment receivers that receives the radio waves emitted from the pairs of antennas 5.

In a third embodiment, the first and second embodiments are combined, so that the ball 6 comprises first and second emitter means as well as receiving means and the pairs of antennas 5 switches between emitting and receiving, and the auto-calibration transmitters 8 are simultaneous switched between receiving and emitting, wherein said switching is of a high frequency to match the high processing frequency. Alternatively, the system in the third embodiment may comprise separate pairs of antennas 5 for emitting and receiving, and a double set of auto-calibration transmitters 8 may be provided, so that each transmitter 8 is dedicated to emitting or receiving only. The advantage of the third embodiment is that the means for determining whether the ball 6 is passing the goal plane are doubled which improves the reliability of the system.

It is not the most suitable solution to situate the receiver and/or the emitter at the middle of the ball 6 as the position is not easily accessible and an item suspended within the ball 6 may be displaced, in particularly during the deformation of the ball 6 at impact with e.g. a player, the play field or the goal. It is preferred that the receiver and/or emitter comprises four or more antennas arranged on the inside of the inner latex balloon within the ball 6, alternatively on the outside of said balloon, where said antennas are distributed evenly on the spherical surface, whereby a spatial resolution of the system of 10 millimeters or less may be obtained. A more heavy part of the emitter and/or receiver may be situated opposite the valve of the ball 6 to be counter balanced thereby. Said antennas may alternatively be situated on the inner side of or within the outer part of the ball 6, e.g. as thin metal wire used to fasten the patches of the outer part to each other.

The invention claimed is:

1. A system comprising:

a movable object, a plurality of pairs of antennas arranged with a goal including two goal posts and a horizontal crossbar that delimit a periphery of a flat target plane, one antenna of each of said pairs being arranged and displaced from the other antenna of each of said pairs in a direction perpendicular to the flat target plane, radio wave emitter means arranged in the movable object and/or each antenna, and means for receiving radio waves from the radio wave emitter means and for providing an output accordingly arranged in each antenna and/or in the movable object, at least one stationary auto-calibration transmitter arranged in the flat target plane and configured to provide a calibration signal to the plurality of pairs of antennas, and processing means to receive and process said output together with a predetermined set of conditions and to provide a resulting output if the set of conditions are fulfilled so as to determine whether the movable object passes the flat target plane.

2. A system according to claim 1, wherein at least some of the pairs of antennas are arranged in series along a horizontal line of the target plane.

3. A system according to claim 2, wherein the pairs of antennas are arranged substantially equidistantly along said line.

4. A system according to claim 1, wherein the pairs of antennas are arranged with a mutual distance of half a wavelength of the radio waves emitted from the emitter means.

5. A system according to claim 1, wherein said pairs of antennas arranged on the goal are arranged within goalposts and/or the horizontal crossbar so that a substantially smooth surface of the goal is preserved.

6. A system according to claim 1, further comprising at least one stationary calibrator device arranged in the flat target plane to provide a calibration signal for the system.

7. A system according claim 1, wherein each pair of antennas has a first antenna arranged in a first plane parallel to said flat target plane and a second antenna arranged in a second plane parallel to said flat target plane.

8. A system according to claim 1, wherein the radio wave emitter means and/or the receiver means of the movable object comprises antenna means regularly distributed in a shell of a shape corresponding to an outer shape of said movable object.

9. A system according to claim 8, wherein the antenna means is arranged on an inner surface of a top layer material of said movable object.

10. A system according to claim 1, wherein said mutual displacement between the antennas of each pair is within the range of 3 to 25 centimeters.

11. A system according to claim 1, wherein a number of pairs of antennas is within a range of 3 to 20.

12. A system according to claim 1, wherein the emitter means is arranged in the movable object and the receiver means is arranged in the plurality of pairs of antennas.

13. A system according to claim 1, wherein the emitter means is arranged in the plurality of pairs of antennas and the receiver means is arranged in the movable object.

14. A system according to claim 1, wherein said emitter means as well as said receiver means are arranged in the movable object and corresponding receiver means as well as emitter means are arranged in a plurality of pairs of antennas placed along the periphery of said flat target plane.

15. A system according to claim 1, further comprising one or more cameras controlled by controlling means that receives the output from the receiving means so that a picture frame is recorded by the at least one camera concurrently with passage of the movable object through the target plane.

16. A system comprising:

a movable object, a plurality of pairs of antennas arranged with a goal including two goal posts and a horizontal crossbar that delimit a periphery of a flat target plane, both antennas of each of said pairs being arranged and displaced at a discernable depth from said flat target plane, radio wave emitter means arranged in the movable object and/or each antenna, and means for receiving radio waves from the radio wave emitter means and for providing an output accordingly arranged in each antenna and/or in the movable object, at least one stationary auto-calibration transmitter arranged in the flat target plane and configured to provide a calibration signal to the plurality of pairs of antennas, and processing means to receive and process said output together with a predetermined set of conditions and to provide a resulting output if the set of conditions are fulfilled so as to determine whether the movable object passes the flat target plane.

17. The system of claim 16, wherein said discernable depth is directionally within said goal.

* * * * *